United States Patent [19]

Monoson et al.

[11] Patent Number: 5,076,079

[45] Date of Patent: Dec. 31, 1991

[54] ANTI-THEFT DEVICE FOR COMPUTERS AND THE LIKE

[76] Inventors: David B. Monoson, 1530 Coolidge Ave.; Jack Greenfield, 2 Irving St., both of Baldwin, N.Y. 11510

[21] Appl. No.: 467,895

[22] Filed: Jan. 22, 1990

[51] Int. Cl.[5] ..... E05B 73/00

[52] U.S. Cl. ..... 70/58; 70/258; 248/553; 248/680

[58] Field of Search ..... 70/58, DIG. 57, 258, 70/19; 248/551-553, 500, 205.3, 670, 674, 680; 211/26

[56] References Cited

U.S. PATENT DOCUMENTS

| | | | |
|---|---|---|---|
| 3,564,879 | 2/1971 | Bennett . | |
| 3,945,227 | 3/1976 | Reiland | 70/DIG. 57 X |
| 4,007,613 | 2/1977 | Gassaway | 70/DIG. 57 X |
| 4,022,037 | 5/1977 | Walters | 70/DIG. 57 X |
| 4,031,721 | 6/1977 | Anderson | 70/DIG. 57 X |
| 4,047,686 | 9/1977 | Porter | 248/552 |
| 4,079,604 | 3/1978 | Anderegg | 70/58 |
| 4,170,324 | 10/1979 | Stubbings | 70/58 X |
| 4,258,596 | 3/1981 | Bisbing et al. | 411/403 X |
| 4,556,188 | 12/1985 | Allison, Jr. | 248/553 |
| 4,603,829 | 8/1986 | Koike et al. | 248/553 |
| 4,627,589 | 12/1986 | Hotsumi | 248/346 |
| 4,691,891 | 9/1987 | Dionne | 248/205.3 X |
| 4,696,449 | 9/1987 | Woo et al. | 248/553 |
| 4,712,763 | 12/1987 | Leite | 248/553 |
| 4,733,840 | 3/1988 | D'Amore | 248/205.3 |
| 4,739,637 | 4/1988 | Finkel et al. | 70/58 |
| 4,833,901 | 5/1989 | Sage et al. | 70/58 |
| 4,843,848 | 7/1989 | Igelmund | 70/58 |
| 4,915,275 | 4/1990 | Brown | 248/205.3 X |
| 4,946,121 | 8/1990 | Troke | 248/205.3 X |

FOREIGN PATENT DOCUMENTS 2134587 8/1984 United Kingdom .

*Primary Examiner*—Lloyd A. Gall
*Attorney, Agent, or Firm*—Louis Weinstein

[57] ABSTRACT

An equipment housing is secured against removal from a clamping assembly which embraces two opposing sides of the equipment housing. Plates are affixed to said opposite sides of the housing by an adhesive means arranged in a unique manner to rely upon its shear strength to prevent unauthorized removal of the equipment or housing or both. The various types of adhesives which may be used in connection with this shear strength locking device may include single part adhesives which consist of liquids of various viscosity, as well as amorphous materials, films and layered films which include various types of double-sided tapes. Another category of adhesives is the multipart material which may consist of two-part epoxies or two-part acrylics. For the most part, high-tack adhesives, which cure at normal room temperatures, are the preferred material.

Cyanoacrylates and similar matrials may be used where rapid cure and adhesion of dissimilar parts is required. All of the foregoing materials are included, and are hereinafter referred to as "adhesives."

These plates have openings cooperating with pins forming a part of the clamping assembly. The shear strength of the adhesive or glue prevents the equipment housing from being removed from the clamping assembly without demolishing the equipment housing. The clamping assembly is adjustable to accommodate housings of varying sizes. The clamping assembly may be directly affixed to a support or table or alternatively may be affixed to an anchoring structure by a flexible cable.

14 Claims, 11 Drawing Sheets

*Fig. 2d*
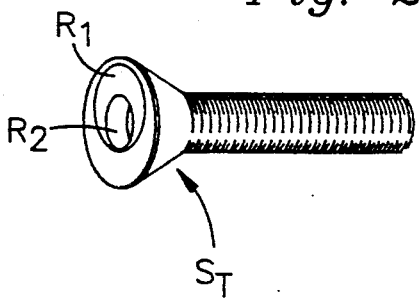
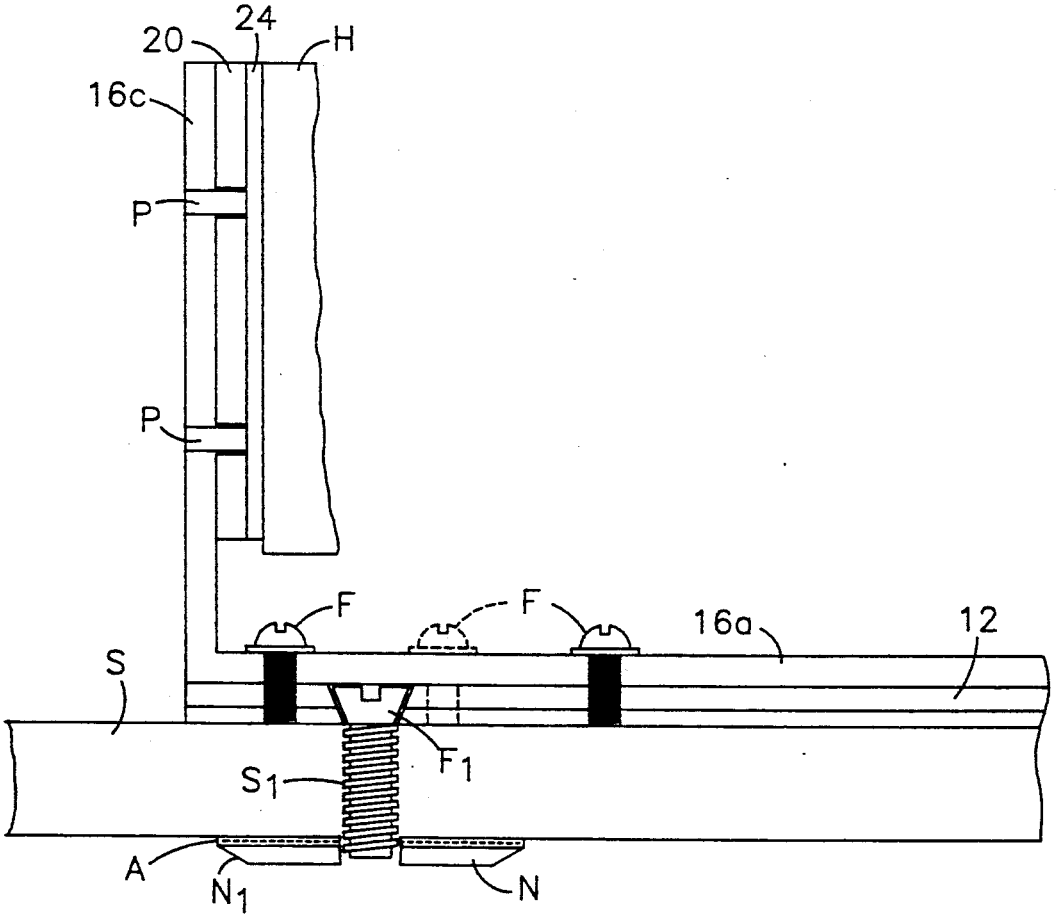
*Fig. 1a*

Fig. 3d
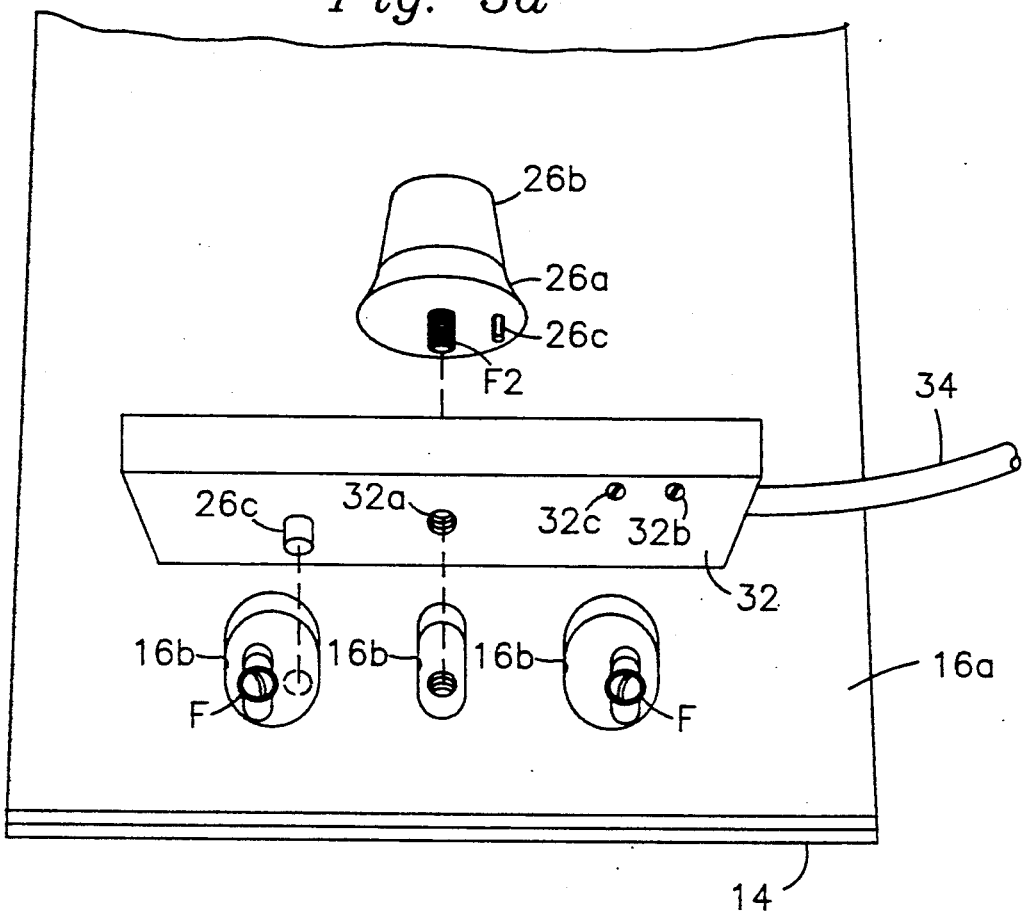
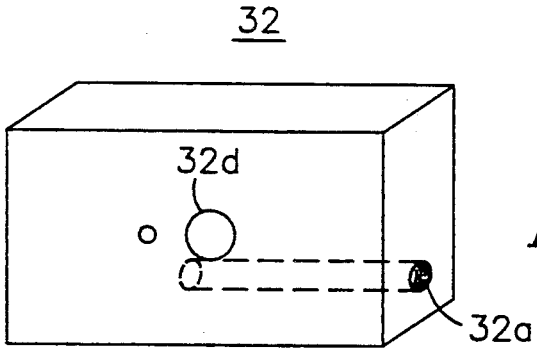
Fig. 3a
Fig. 3b
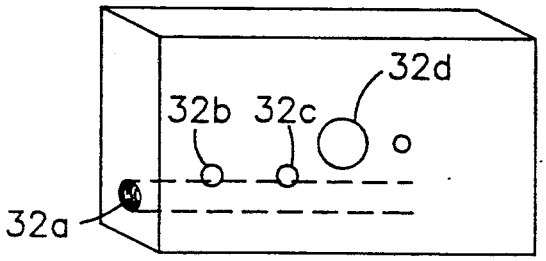

ANTI-THEFT DEVICE FOR COMPUTERS AND THE LIKE

FIELD OF THE INVENTION

The present invention relates to anti-theft devices and more particularly to a novel anti-theft device for preventing removal of an equipment housing from a low profile clamping assembly which utilizes the shear strength of an adhesive means to prevent separation of the equipment housing from the clamping assembly.

BACKGROUND OF THE INVENTION

A variety of techniques and apparatus have been developed through the years for preventing the unauthorized removal of equipment, such as, for example, office equipment. Such apparatus has been known to incorporate bracket assemblies placed between the equipment housing and a supporting surface and being either permanently or releasably secured to both the equipment housing and the supporting surface typically through the use of locks, threaded fasteners and other interlocking components.

The development of sophisticated adhesives have led to the use of such materials in anti-theft applications. For example, anti-theft apparatus presently in use utilizes double-sided adhesive strips for securing an equipment housing to a supporting surface. Such sheets may alternatively be placed between the equipment housing and a mounting plate which, in turn, is either affixed directly to a supporting surface by a second adhesive strip, epoxy or glue or alternatively may be secured to some stationary object or surface by means of a cable having a first end affixed to the aforementioned plate and a second end affixed to an anchoring location. Such arrangements rely upon the peel and/or tensile strength of the adhesive used and may therefore be compromised.

BRIEF DESCRIPTION OF THE INVENTION

It is, therefore, one object of the invention to provide novel non-invasive, anti-theft apparatus for computer and equipment housings and the like employing an adhesive means arranged in a unique manner to rely upon its shear strength to prevent unauthorized removal of the equipment or housing or both.

The various types of adhesives which may be used in connection with this shear strength locking device may include single part adhesives which consist of liquids of various viscosity, as well as amorphous materials, films and layered films which include various types of double-sided tapes. Another category of adhesives is the multipart material which may consist of two-part epoxies or two-part acrylics. For the most part, high-tack adhesives, which cure at normal room temperatures, are the preferred material.

Cyanoacrylates and similar materials may be used where rapid cure and adhesion of dissimilar parts is required. All of the foregoing materials are included, and are hereinafter referred to as "adhesives". The adhesive means forms an integral part of such apparatus and is used in a unique manner wherein the anti-theft assembly relies upon the shear strength of the material employed to yield excellent anti-theft protection as a result of the very significant increase in the holding forces exerted upon the equipment housing by the anti-theft apparatus.

The present invention, in one preferred embodiment, comprises a clamping or holding assembly having first and second clamping arms which embrace an equipment housing arranged therebetween and including means for adjusting the spacing between said clamping arms as well as retaining the desired spacing. A pair of side plates are each releasably mounted upon one of said arms by suitable pin means arranged on said arms so as to be inserted within openings provided in said plates. Alternatively any other type of mounting means may be utilized which prevents movement of each side plate relative to its associated clamping arm in mutually perpendicular directions to assure the effectiveness of the adhesive means 22, 24. A suitable adhesive means is arranged between the housing surface and the plate to join each plate to the equipment housing. The aforementioned adjustable means is adjusted to press the arms against the aforementioned plates. The arms are preferably inclined at an angle of approximately one-half degree (0.5°) to defeat any attempt to peel the plates away from the equipment housing. The force required to defeat the adhesive in a shearing direction is so great that the equipment housing would have to be severely distorted in order to remove the equipment from the anti-theft clamping assembly which would result in significant equipment damage.

The clamping assembly may be directly mounted to a supporting and preferably relatively immovable surface by suitable fastening means. Alternatively, the clamping assembly may be joined to an anchoring location by means of a sturdy, flexible metal cable having a first end or portion thereof joined to said clamping assembly and a second portion or end thereof joined to suitable anchoring means. This arrangement allows some movement of the equipment without affecting the integrity of the anti-theft clamping assembly.

The means for adjusting the spacing of the clamping assembly arms may comprise a plate joined to said arms by means of suitable fastening members at least one of which is of the anti-theft type. Alternatively, the aforementioned plate may be integrally joined to one of said arms and releasably joined to the remaining one of said arms by suitable locking means.

The material or means utilized for joining said plates to the equipment housing may be a suitable adhesive as defined hereinabove in liquid or solid form or a sheet provided with an industrial grade pressure-sensitive adhesive applied to opposing major surfaces. Any of these techniques may be employed with equal success, although the double-sided adhesive sheet is the easiest to use, especially in field applications. All of these materials and techniques are non-invasive and completely avoid the need to penetrate the equipment housing.

For applications in which the internal mechanism may be removable through the front or rear of the housing, an anchor cleat is provided for preventing unauthorized removal of the equipment from the housing simply by removing the fastening screws, the anchor cleat blocking removal of the chassis and/or housing contents while at the same time providing the same type of non-invasive design as the remainder of the security system.

OBJECTS OF THE INVENTION

It is, therefore, one object of the present invention to provide a novel anti-theft clamping assembly for equipment housings and the like in which the housings are joined to the clamping assembly by suitable adhesive material which is arranged in such a way as to rely upon the shear strength of the adhesive material to prevent removal of the equipment housing from the clamping assembly.

Still another object of the present invention is to provide a novel anti-theft clamping assembly for protecting equipment housings and the like which relies upon the shear strength of an adhesive material as the principal means for preventing removal of the equipment from the clamping assembly and further including an arrangement for accommodating and protecting equipment housings of various sizes.

Still another object of the present invention is to provide a novel anti-theft clamping assembly for protecting equipment housings and the like wherein the clamping assembly, which utilizes the shear strength of an adhesive material for the principal clamping force exerted upon the equipment housing, further includes means for either directly affixing the clamping assembly to a supporting surface or for anchoring the equipment to a permanent or immovable structure by means of a flexible metal cable.

Still another object of the present invention is to provide a novel anti-theft clamping assembly for protecting equipment housings and the like which utilizes the shear strength of an adhesive material as the principal means for preventing removal of the equipment housing from the clamping assembly and further includes an anchor cleat for preventing unauthorized removal of the equipment from the housing by blocking removal of a housing cover plate or at least the contents thereof, said anchor cleat being of a low profile and cooperating with the equipment housing in a non-invasive manner.

BRIEF DESCRIPTION OF THE FIGURES

The above, as well as other objects, of the present invention will become apparent when reading the accompanying description and drawings in which:

FIG. 1*a* shows an elevational view, partially sectionalized of a portion of the anti-theft clamping assembly of FIG. 1;

FIG. 2*d* shows a tamperproof screw which may be substituted for the lock of FIG. 1;

FIGS. 3*a* and 3*b* are front and rear perspective views of the anchor block of FIGS. 2 and 2*a;*

FIG. 3*d* is an exploded perspective view of the assembly 14, 16, 32 of FIG. 2;

DETAILED DESCRIPTION OF THE INVENTION AND PREFERRED EMBODIMENTS THEREOF

Figure 1:
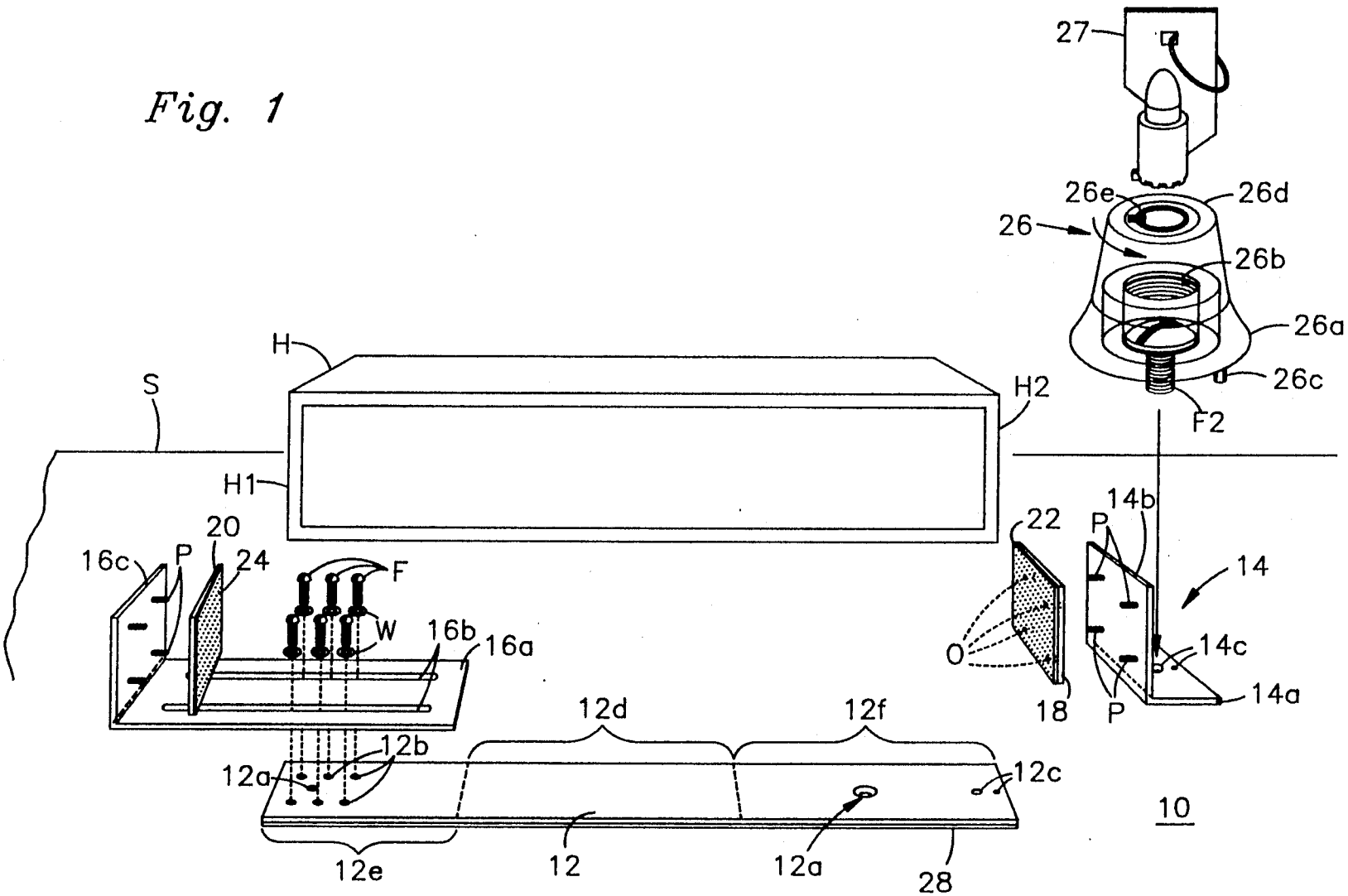
FIG. 1 is an exploded perspective view showing one preferred embodiment of the present invention.

FIGS. 1 and 1*a* show a low profile security system 10 comprised of base plate 12, fixed end bracket 14 and adjustable end bracket 16 for embracing and locking an equipment housing designated schematically by housing H, upon a surface S which may, for example, be a desk or table top, or other working surface. Housing H may enclose a computer, VCR or other type of electronic, electromechanical or mechanical equipment.

Bracket 14 is comprised of integral arms 14*a* and 14*b*. Arm 14*a* is provided with suitable openings 14*c* for receiving and mounting a lock which may, for example, be a high security cylindrical tumbler lock 26 to be described further hereinbelow.

Arm 14*b* is provided with a plurality of pins adapted to extend into openings O provided in side plate 18. A sheet 22 of a suitable industrial strength adhesive is placed across the left-hand surface of plate 18 and may be provided with openings O coaligned with the openings in plate 18 for receiving and positioning the pins P extending from side plate arm 14*b*, in the event that pins P extend beyond the left-hand surface of plate 18. Preferably the relative length of pins P and thickness of plate 18 is such that pins P do not engage the surface $H_2$ of housing H. Obviously, when the thickness of plate 18 is greater than the length of pins P, sheet 22 need not be provided with openings.

Figure 1B:
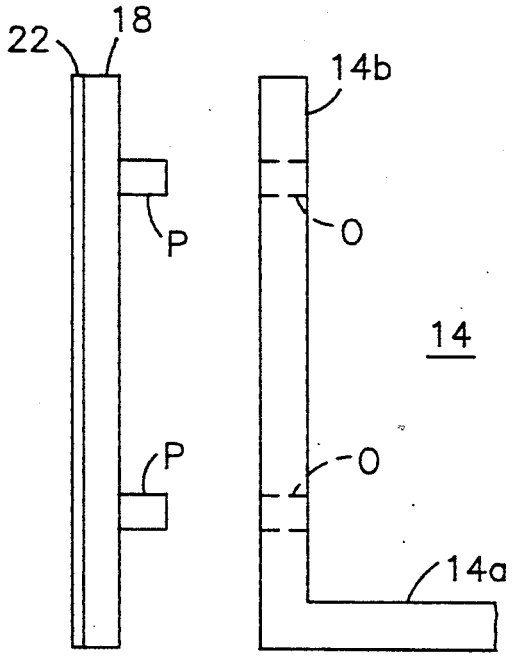
FIG. 1*b* shows another alternative arrangement for the side plate and docking means shown in FIG. 1.

Although the preferred embodiment shows the bracket portions 14*b* and 16*c* as being provided with pins for insertion into openings in the side plates 18 and 20, it should be understood that this arrangement can be reversed by providing integral pins upon side plates 18 and 20 and providing openings in brackets arms 14*b* and 16*c*. See FIG. 1*b* which shows side plate 18 provided with pins P and bracket portion 14*b* provided with openings O. The pins in openings are not limited to having a cylindrical shape and may, for example, be square, rectangular, or any polygonal, or oval cross-section.

End bracket 14 is releasably mounted to the right-hand end of base plate 12 having openings 12*c* which are aligned with openings 14*c* for receiving the lock bolt $F_2$ and pin member 26*c* of lock 26, the lock bolt threadedly engaging a threaded opening (the larger opening 12*c*) in base plate 12 while the pin 26*c* extends through the smaller opening 12*c* to prevent the security lock from being rotated.

Although the embodiment of FIG. 1 is shown as employing a security lock 26, any other type of lock or tamperproof screw (to be more fully described) may be utilized with equal success for releasably locking end bracket 14 to base plate 12 in a secure manner, the lock 26 shown in FIG. 1 being merely exemplary to show the need for a removable locking means.

Adjustable end bracket 16 is comprised of integral bracket arms 16*a* and 16*c*. Arm 16*c* is provided with integral pins P similar to those provided along arm 14*b* of end bracket 14. Similarly, side plate 20 is provided with a double-sided adhesive sheet 24, side plate 20 and sheet 24 having openings O (when needed) coaligned with the pins P for receiving and seating these pins.

Integral arm 16*a* is provided with elongated slots 16*b*. A plurality of openings are provided near the left-hand end of base plate 12. The openings 12*b* are aligned with at least one of the elongated slots 16*b* and are tapped so as to cooperate with threaded fasteners F extending through the elongated slots. If desired, metallic, fabric or plastic washers W may be employed. The threaded fasteners are initially loosened sufficiently to enable end plate 16 to be moved either toward the left or toward the right relative to base plate 12 to adjust the distance between side plates 18 and 20 and hence between arms 14*b* and 16*c* to accommodate equipment housings of varying sizes.

Base plate 12 is provided with openings 12*a* each receiving a threaded fastener $F_1$ which extends through an opening 12*a* in base plate 12, an opening $S_1$ in the surface S and threadedly engages a preferably tamperproof disc-shaped nut N adhered to the underside of surface S by means of a double-sided adhesive strip A and which prevents removal thereof by virtue of its disc shape, its chamfered edge $N_1$ and the double-sided adhesive strip A (see FIGS. 1 and 1*a*). The fasteners $F_1$ extending through holes 12*a* are concealed by housing H and cannot be accessed when the equipment is secured in position.

As an alternative to the arrangement of FIG. 1, base plate 12 may be replaced by two separate base plates, for example, by eliminating a central portion 12*d* extending between a pair of parallel dotted lines. Such an arrangement eliminates the need for the adjustability of end bracket 16. Additional openings of the type shown as opening 12*a* may be provided for each of the plate portions 12*e* and 12*f* to adequately secure these plate portions to surface S.

Alternatively, the plate portions 12*d* and 12*e* may be totally eliminated and arm portion 16*a* may be mounted directly to surface S.

The manner in which the embodiment of FIGS. 1 and 1*a* is utilized is as follows:

Base plate 12 is joined to surface S through the use of the threaded fasteners $F_1$. Alternatively, if desired, the double-sided adhesive sheet 28 may be affixed to the undersurface of base plate 12. It should be understood that the exposed surfaces of adhesive sheets 22, 24 and 28 are preferably covered with a protective sheet (not shown) that is peeled away immediately prior to use, as is conventional. The double-sided adhesive sheet 28, of a suitable industrial strength adhesive may be used either alone or in combination with the fasteners $F_1$ to affix base plate 12 to working surface S. The double-sided adhesive strips 22 and 24 are affixed to the side surfaces $H_1$ and $H_2$ of housing H. The side plates are initially mounted upon the associated end bracket arms by means of pins P and the end brackets 16 and 14 are appropriately positioned. Fasteners F and $F_1$ are totally concealed beneath housing H.

End bracket 14 is initially removed to enable housing H to be displaced from the low profile system at which time the fasteners F are secured. Plate 20 affixed to the left side $H_1$ of housing H is mounted upon bracket arm 16*c* by means of pins P. End bracket 14 is then mounted upon side plate 18 and lock 26 or other appropriate tamperproof means joins end bracket arm 14*a* to base plate 12.

The cylindrical tumbler lock 26 is provided with a lower portion 26*a* having a recessed opening 26*b* in its base portion for receiving and seating the head of a threaded fastener $F_2$. A pin 26*c* is integrally joined to the undersurface of block portion 26*a*. Upper portion 26*d* of the lock is interfitted with lower portion 26*a* and has a locking mechanism 26*e* operated by key 27 to extend a slidable projection into a slot in the sidewall of lower lock portion 26*a* to lock upper portion 26*d* to lower portion 26*a* thereby preventing access to threaded fastener $F_2$. Pin 26*c* prevents the lock from being rotated about its longitudinal axis. The lock employed may, for example, be a High Security Cylindrical Tumbler Lock sold by Avdex Corporation. However, any other locking means capable of releasably locking the end 14 to base plate 12 may be employed.

The side plates may be adhered to the equipment housing by any of the aforementioned adhesive means for joining a side plate to the equipment housing. One suitable means may, for example, be a double-stick, industrial type, high density rubber base film, Norton type V2830.

As an alternative to lock 26, a tamperproof screw $S_T$ such as that shown in FIG. 2*d* may be employed. The screw head is provided with a first circular recess $R_1$ and a second smaller circular recess $R_2$ arranged with recess $R_1$. One such tamperproof screw is the AVDEX Tamperproof Screw sold by Avdex Corporation. Obviously any other suitable locking means may be employed, if desired, the particular locking means being independent of the novel "locking" feature provided due to the shear strength provided by the adhesive means 20, 22.

Arm 14*b* is aligned at an angle of the order of 90.5 degrees relative to arm 14*a*. Conversely, arm 16*c* is aligned at an angle of the order of 89.5 degrees relative to arm 16*a*. These inclinations cause arms 14*b* and 16*c* to tilt inwardly toward housing H at an angle of the order of 0.5 degrees against end plates 18 and 20 to prevent attempts to peel plates 18 and 20 away from housing H. The force required to defeat the double-sided adhesive strips 22 and 24 in a shearing motion is so great that the equipment housing H and contents would be severely damaged in the process.

The use of the double-sided adhesive sheets is non-invasive, does not require that any holes be made into the equipment housing, and does not require that any components project into the housing interior, thus avoiding an harmful effect on equipment operation and hence upon manufacturer's warranties. In addition, the system is designed for quick installation by personnel that do not require any particular expertise other than that normally required for ordinary maintenance. The low profile of the system minimizes the amount of exposed surface of housing H engaged by system 10.

In the event that the equipment housing has a removable front $P_F$ (FIG. 2*f*) or a chassis $P_R$ that may be slidably removed from housing H (FIG. 2*g*), the arm 42*b* of angle bracket 42 (FIG. 2*e*) is mounted to surface S by fastener $F_2$. Angle arm 42*a* blocks the front panel $P_F$ or rear panel and chassis $P_R$ from being removed from housing H.

FIGS. 2, 2*a* and 3*a*–3*d* show another alternative embodiment of the present invention wherein like components as compared with the embodiment of FIG. 1 are designated by like numerals. The low profile locking system 60 is comprised of end brackets 14 and 16 directly joined together by fasteners of the type shown as F in FIG. 1 and pass through elongated slots 16*b* and into threaded openings 14*d*. Plates 18 and 20 are releasably joined to bracket arms 14*b* and 16*c* by pins P in a manner similar to that described with regard to the embodiment of FIG. 1. The fasteners F are concealed beneath an anchor block 32. The fasteners F threadedly engage selected ones of the threaded openings 14*d* in bracket arm 14*a* to secure end bracket 14 to end bracket 16. Fastener $F_2$ (of lock 26) extends through the central opening 32*c* in anchor block 32 and center slot 16*b* and threadedly engages center threaded opening 14*d*. Opening 32*d* receives the pin 26*c* forming part of the security lock 26, the pin from the security lock being fitted into opening 32*d* to prevent the security lock from being rotated about its vertical axis.

Figure 2A:
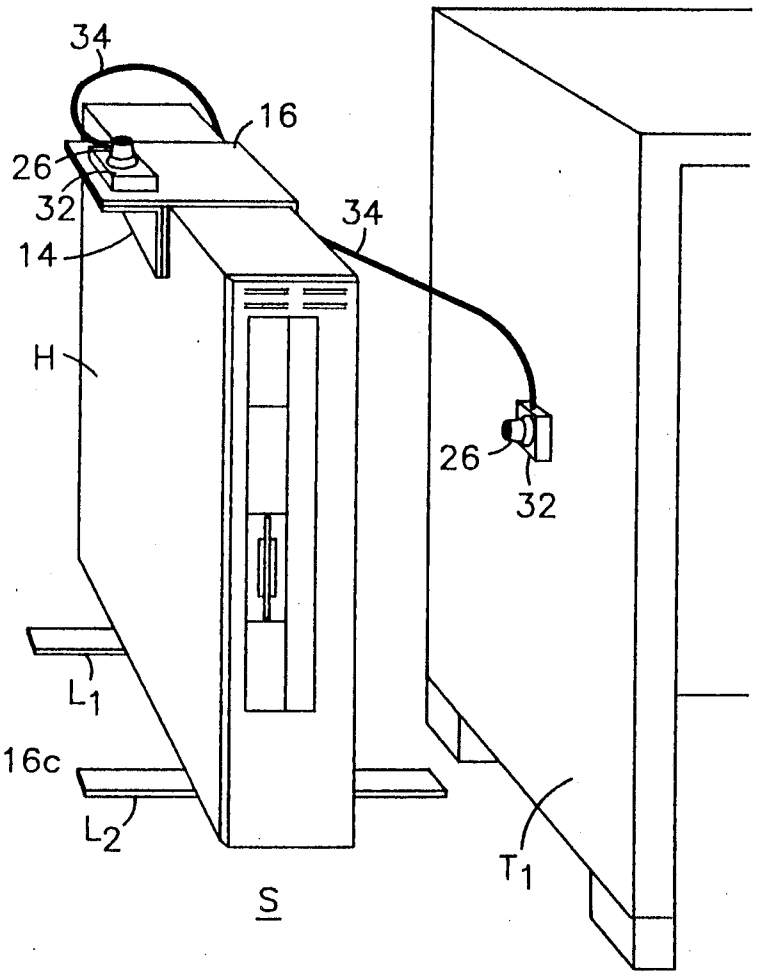
FIG. 2*a* is a perspective view showing one manner in which the clamping assembly of FIG. 2 may be utilized to anchor the equipment housing of FIG. 2.
Figure 2:
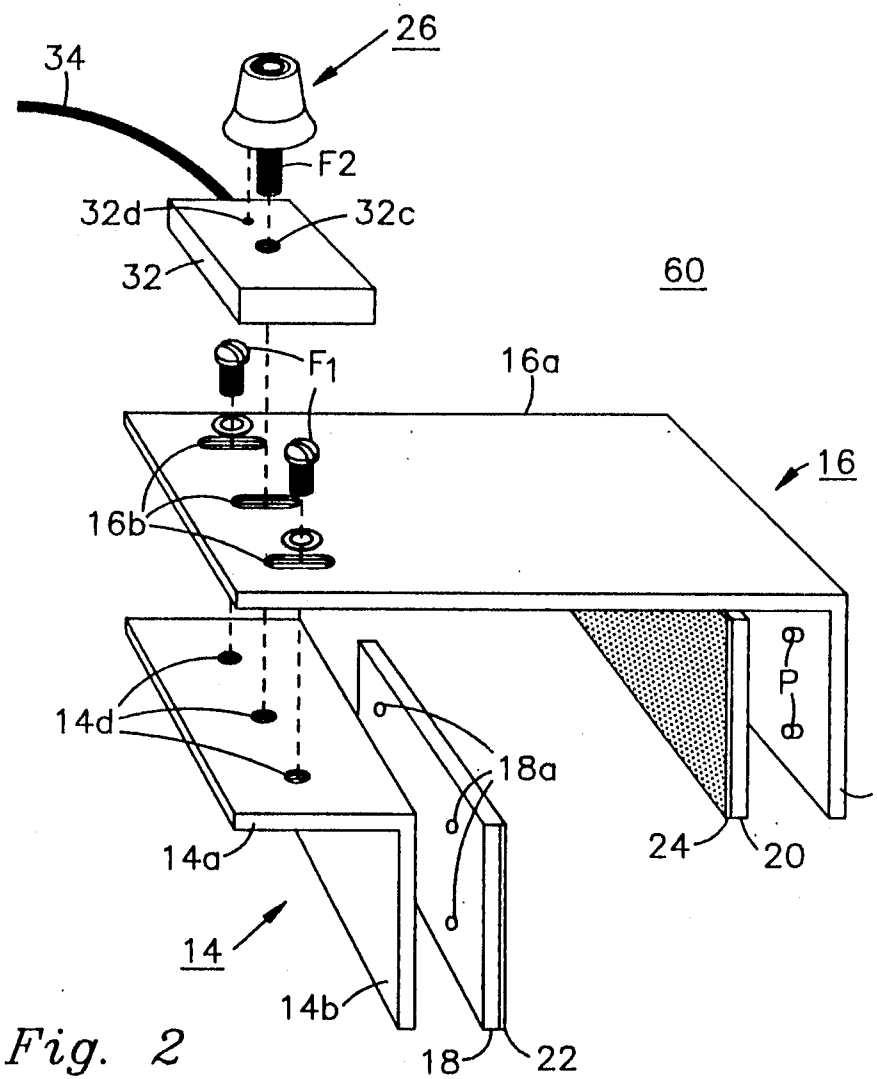
FIG. 2 is an exploded perspective view of another preferred embodiment of the present invention.

The security system 60 of FIGS. 2 and 2*a* is secured to a suitable non-movable structure such as the vertical sidewall of a table $T_1$. A heavy duty cable 34 is rigidly secured at each of its ends to a rugged block 32, being respectively secured by a locking means, such as lock 26, to locking system 60 and the vertical sidewall of a table $T_1$. The blocks 32 of FIGS. 2 and 2*a* are identical, each being provided with an elongated opening 32*a* as shown in FIGS. 3*a* and 3*b*. A pair of threaded openings 32*b*, 32*c* each receive a threaded fastener $F_3$, each of which cuts into a peripheral portion of a heavy duty cable 34 inserted into opening 32*a* which cable may be an aircraft cable of the order of 0.30 inches in diameter, fasteners $F_3$ being substantially tangential to the periphery of cable 34, to secure the cable against removal from block 32.

Block 32 conceals all three slots 16*b* as shown in FIGS. 2 and 3*d*, as well as fasteners $F_1$ and $F_2$. Fastener $F_2$ extends through opening 32*d* in block 32 and threadedly engages a threaded opening in bracket arm 14*a* (see FIG. 2), securing the lower portion 26*a* of locking means 26, and bracket 16 to bracket 14. Anti-spin pin 26*c* of locking means 26 extends through an opening 32*c* in block 32 and into the left-handmost slot 16*b* in bracket arm 16 (see FIG. 3*d*) preventing both locking means 26 and block 32 from being spun off.

Figure 3:
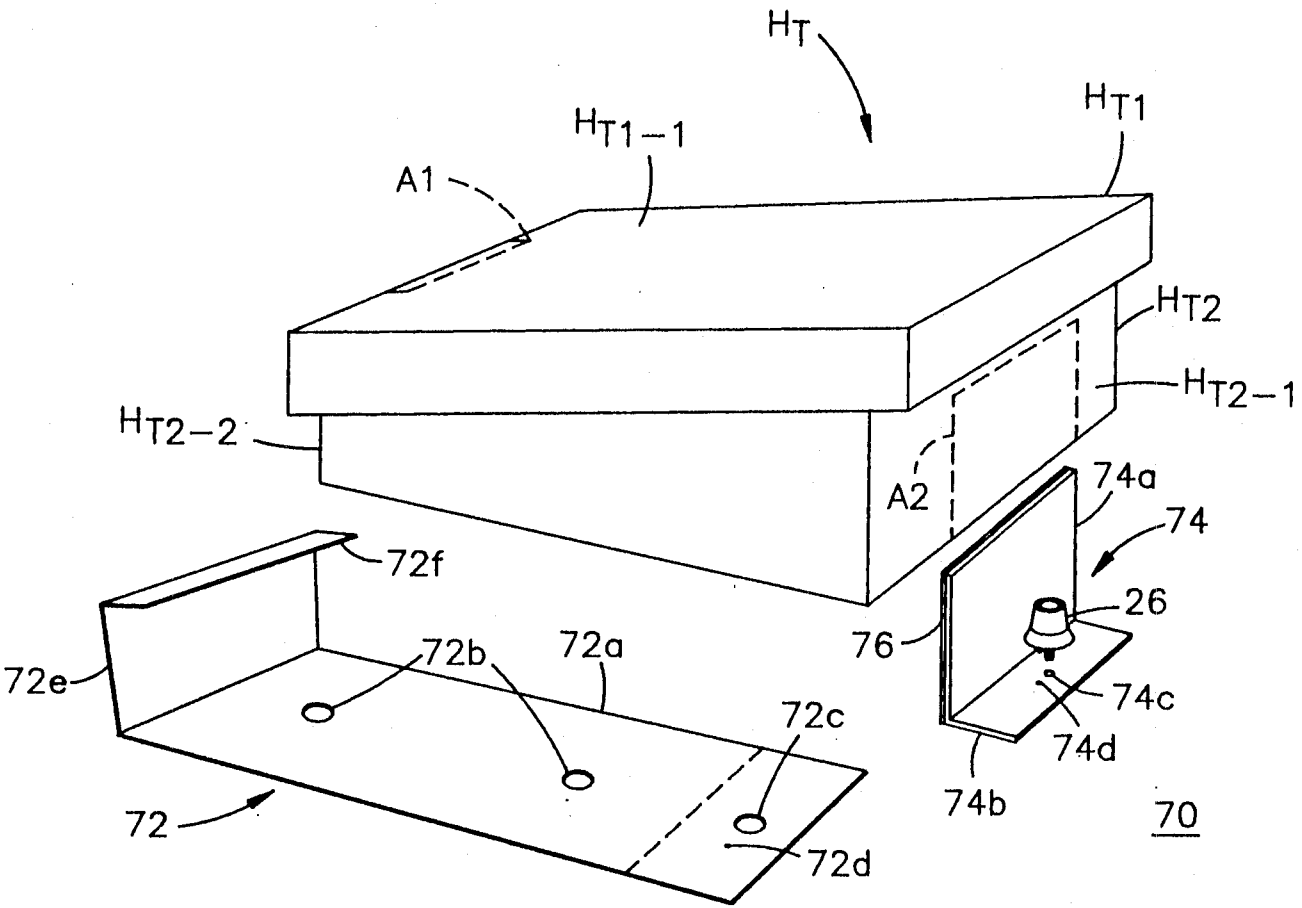
FIG. 3 is an exploded perspective view showing another alternative embodiment of the present invention.
Figures 3C, 3E:
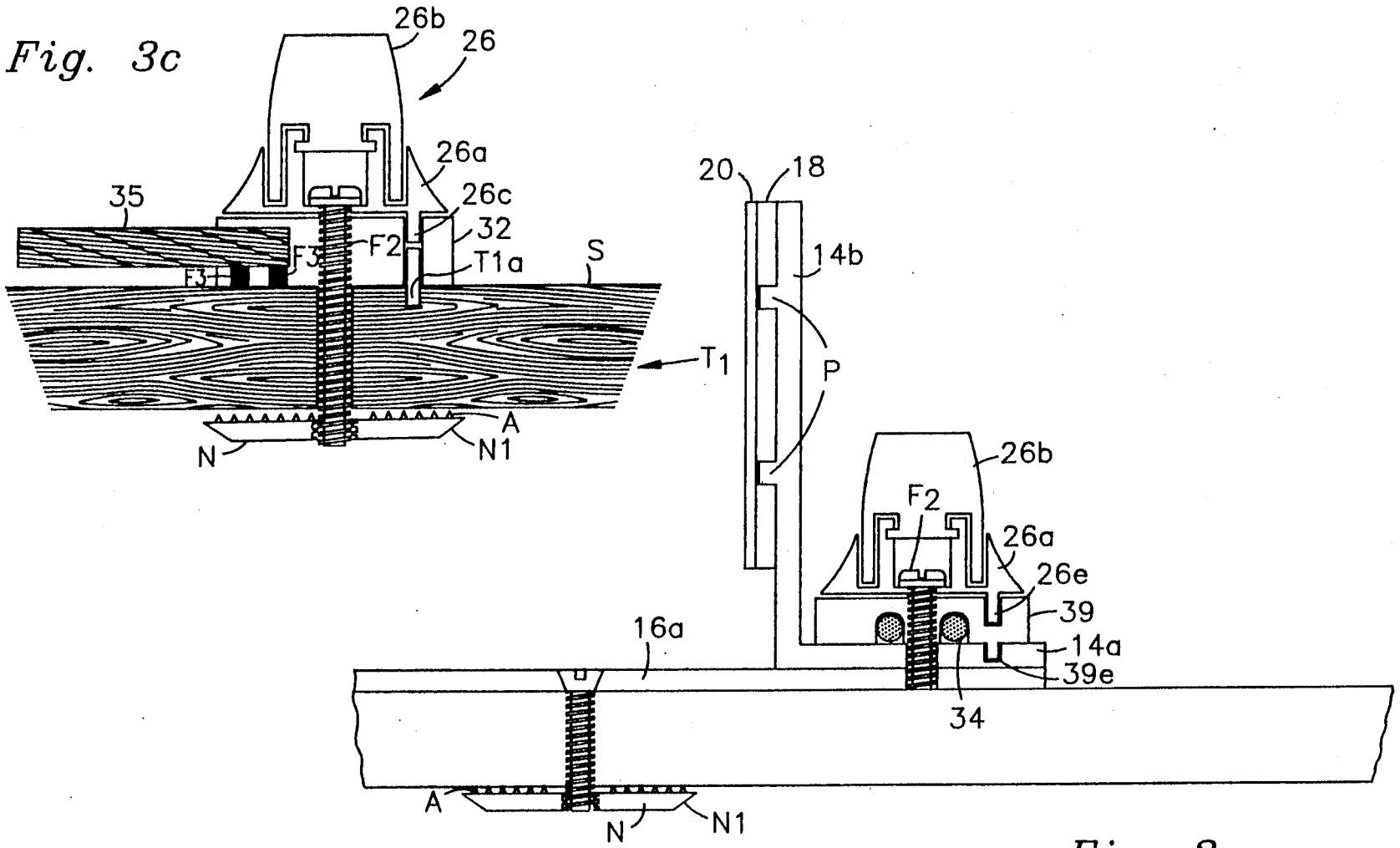
FIG. 3*c* is an end view, partially sectionalized, showing the assembly 32 of FIG. 2*a;*
FIG. 3*e* is a sectional view of the assembly of FIG. 2*b*.

FIG. 3*c* shows the block 32 of FIG. 2*a* secured to the vertical surfaces of table $T_1$. Anti-spin pin 26*c* extends through block 32 and into an opening $T_{1a}$ to prevent locking means 26 and block 32 from being spun off.

Tamperproof disc-shaped nut N (see also FIG. 1*a*) is threadedly engaged by threaded fastener $F_2$ securing block 32 and locking means 26 to table $T_1$. Double-sided adhesive sheet A (FIG. 1*a*) and bevelled edge $N_1$ prevent rotation of disc N.

Figure 2C:
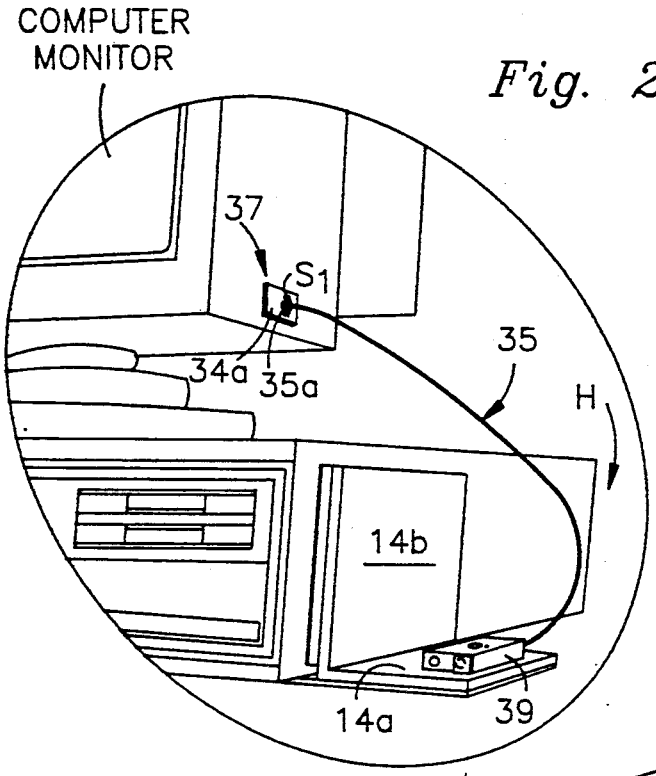
FIG. 2*c* shows still another arrangement for anchoring a cable of the type shown in FIG. 2*a;*
Figure 2B:
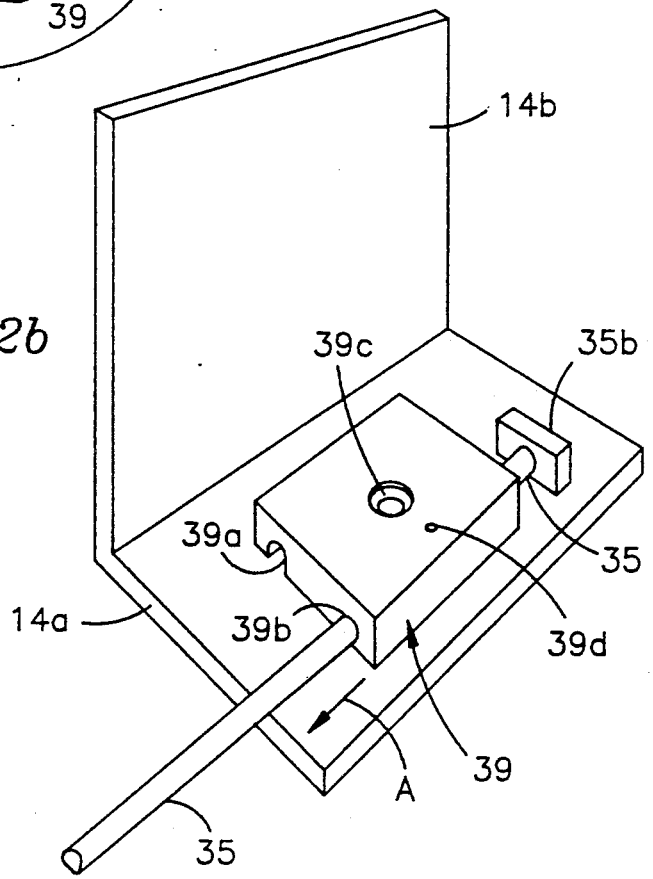
FIG. 2*b* shows an anchoring device which may be employed to join the clamping assembly to the flexible cable shown in FIG. 2*a;*
Figure 2E:
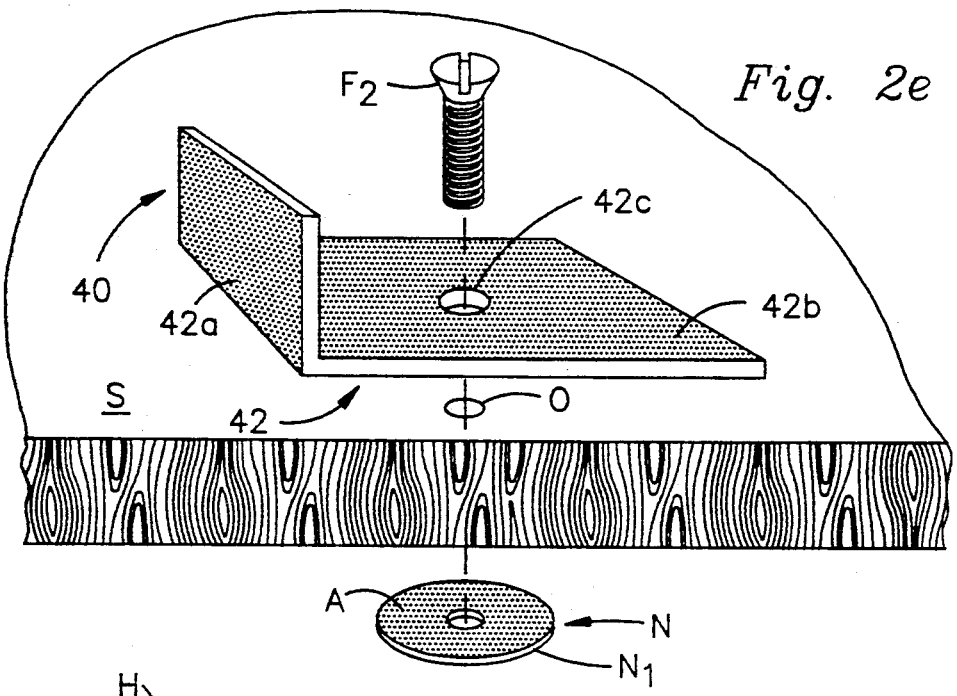
FIG. 2*e* shows an exploded perspective view of an anchor block usable with the security system of FIG. 1.
Figure 2F:
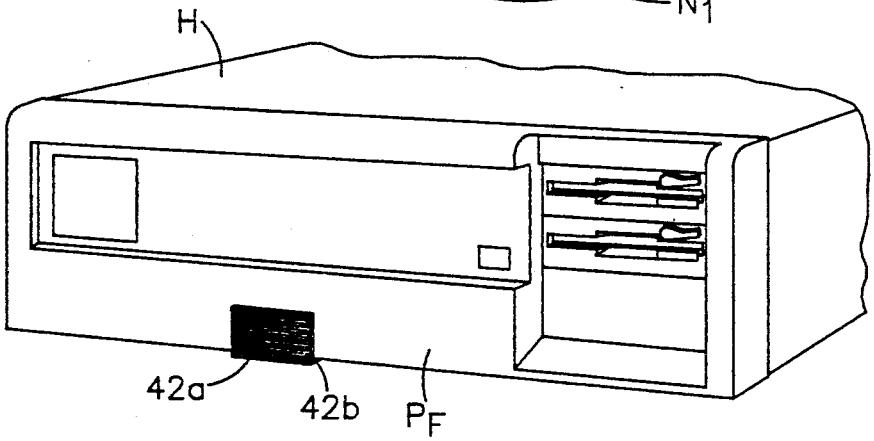
FIGS. 2*f* and 2*g* are perspective views showing the manner of use of the anchor cleat of FIG. 2*e;*
Figure 2G:
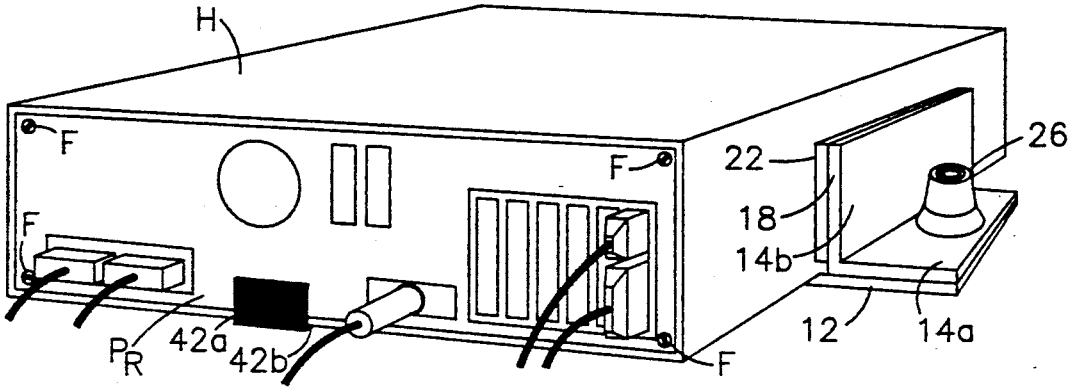
Figure 2H:
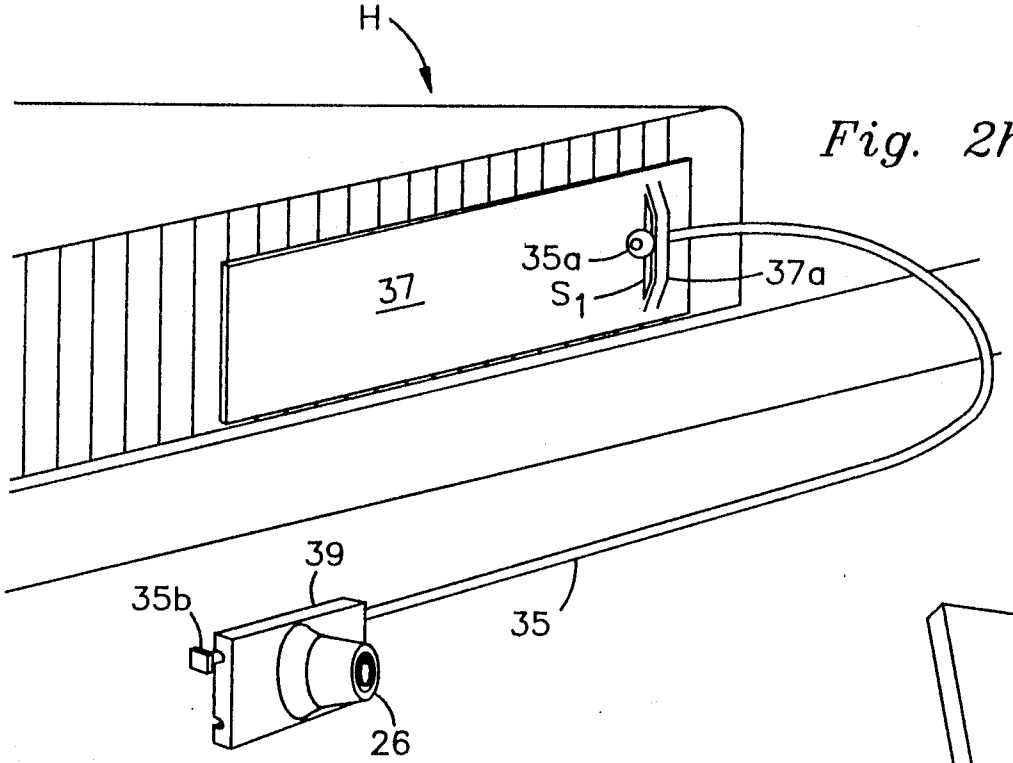
FIGS. 2*h* and 2*i* are perspective views of an accessory for securing an accessory to a security assembly of the type shown in FIG. 1.

Plate 37 (FIGS. 2*c* and 2*h*) is provided as an accessory to enable the user of the equipment lock to protect against removal of adjacent equipment by the use of a conveniently anchored cable, and is adapted for use with the security system embodiment of FIG. 1 wherein the housing H is secured to a desk or table top and a component of lesser value than the computer (such as a display monitor M) is also to be protected.

Figure 2I:
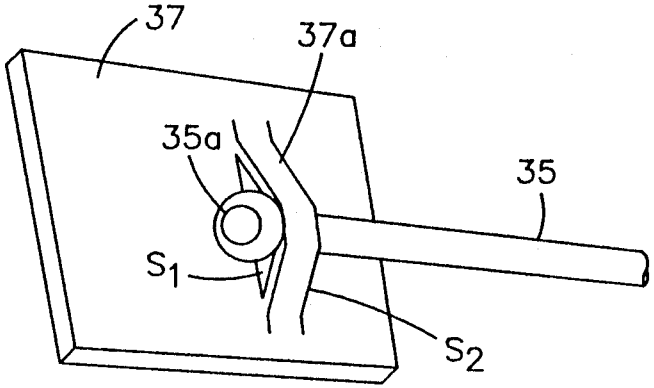

A vinyl jacketed steel cable 35 of smaller diameter than cable 34 (FIGS. 2 and 2*a*) is provided with a large ball-type end stop 35*a* on one end and a smaller "T"-shaped end stop 35*b* on the other. The larger ball-type end stop 35*a* will not fit through the raised slot $S_1$ (FIG. 2*c*) on equipment plate 37 and the smaller "T"-shaped end 34*b* which has previously been inserted through slots $S_1$, $S_2$ (see FIG. 2*i*) in equipment plate 37, is then captured between the groove 39*b* of anchor block 39 and the top surface of bracket arm 14*a*.

The "T"-shaped end 35*b* which is wider than slots $S_1$, $S_2$, prevents the trapped cable 35 from being removed from the anchor block 39.

Block 39 may accommodate another peripheral device (not shown) by placing and locking another cable, similar to vinyl jacketed cable 35, beneath the groove 39*a*. Fastener $F_3$ of locking means 26 extends through opening 39*c* in block 39 and threadedly engages a tapped opening in bracket arm 14*a*. Anti-spin pin 26*c* extends through opening 39*d*. As an alternative arrangement, pin 26*c* may extend only into an opening in block 39 and block 39 may have an anti-spin pin or projection 39*e* extending into an opening in bracket arm 14*a* as shown in FIG. 3*e*.

The security system 60 (FIGS. 2 and 2*a*) embraces the housing H of a piece of equipment such as, for example, a free-standing computer housing or one which is adapted for free-standing support by legs $L_1$ and $L_2$ to maintain the computer housing H in the upstanding or vertical position upon a surface S and in relatively close proximity to an object such as table T which is substantially immovable. The opposite end of cable 34 is anchored to one vertical sidewall $T_1$ of table T by an anchor block 32 and a locking mechanism similar to those described hereinabove. The arrangement shown in FIG. 2*a* enables the housing H to be moved to a variety of positions relative to table T dependent upon the length of rugged, flexible cable 34 while at the same time prohibiting the computer housing from unauthorized movement from the premises. The embodiment 60 in FIG. 2 of the present invention relies on the same shear strength provided by the double-sided adhesive sheets to prevent separation of the equipment housing H from the security system 60.

FIG. 3 shows an exploded perspective view of another preferred embodiment of the present invention for securing an equipment housing which may, for example, be telephone handset housing $H_T$ comprised of an upper cover portion $H_{T1}$ and a lower cover portion $H_{T2}$. Cover $H_{T1}$ is secured by suitable fasteners (not shown). Access to these fasteners is typically along the undersurface of housing portion $H_{T2}$. The equipment housing $H_T$ is designed so as to have a sloping top surface $H_{T1-1}$ typically having a telephone keypad which has been omitted for purposes of simplicity. Housing portion $H_{T2}$ has opposite parallel surfaces $H_{T2-1}$ and $H_{T2-2}$ of differing heights. Also omitted for purposes of simplicity is the conventional handpiece typically electrically connected to the equipment housing $H_T$, and provided with the mouthpiece and earpiece conventionally employed in such telephone handpieces.

The security system 70 adapted to prevent unauthorized removal of the equipment housing $H_T$ then comprises brackets 72 and 74. Bracket portion 72*a* is preferably secured to a supporting surface either by suitable adhesive means such as, for example, a double-sided adhesive sheet or by suitable fastening means extending through openings 72*b*. The free end of arm portion 72*a* is provided with threaded opening 72*c* for receiving a threaded fastener $F_2$ of a locking means 26 shown, for example, in FIG. 1. Opening 72*d* is designed to receive the anti-spin pin 26*c* of locking means 26.

Integral bracket arm 72*e* extends upwardly from bracket arm portion 72*a* and is bent inwardly at 72*f* to embrace a portion of the top surface of housing $H_T$ represented by the area A defined by a dotted line.

Bracket arm 74 is provided with an arm portion 74*a* which may be secured to the larger vertical surface $H_{T2-1}$ with an area $A_2$ being defined by the dotted rectangle as shown. The bracket arm portion 74*a* may be directly adhered to surface area $A_2$ by a double-sided adhesive sheet 76 which may be adhered directly to the adjacent surface of arm portion 74*a* or alternatively be adhered to a side plate such as side plate 18 shown in FIG. 1 which may be releasably joined to bracket arm portion 74*a* by means of pins P provided thereon and received within openings provided in a side plate 18.

Integral arm portion 74*b* is provided with openings 74*c*, 74*d* cooperating with openings 72*c*, 72*d* for receiving locking means threaded fastener $F_2$ and anti-spin pin 26*c* (see FIG. 1).

The security system 70 of FIG. 3 functions in much the same manner as the security system 10 of FIG. 1. Bracket portion 72*a* is secured to a supporting surface either by threaded fasteners or adhesive means in the same manner as was described hereinabove in connection with previous embodiments of the present invention. Housing $H_T$ is placed upon the bracket portion 72*a* so that flange 72*f* embraces the area $A_1$. Adhesive means are applied to surface area $A_2$ and either directly to bracket arm portion 74*a* or to a side plate which cooperates with the bracket arm portion. Bracket 74 may be releasably coupled to bracket 72, for example, by locking means 26 shown in FIG. 1 or any other suitable locking means. The nature of the arrangement shown in FIG. 3 is such that any fastening means either fastening the upper housing portion $H_{T1}$ to lower housing portion $H_{T2}$ or those fasteners securing bracket 72 to a supporting surface and securing bracket 74 to bracket 72, are concealed and access thereto is impractical if not substantially impossible to thereby protect the equipment housing $H_T$. The shear strength of the adhesive means coupled with bracket flange 72 prevents the equipment housing $H_T$ from being lifted upwardly while the shear strength of the adhesive means further prevents the housing from being moved in a direction perpendicular to the horizontal direction and parallel to the surface upon which the equipment housing $H_T$ is supported. The equipment housing $H_T$ may be easily removed for maintenance, repair or replacement purposes simply by removing the locking means 26 or any other suitable locking means utilized as a substitute therefor. The flange 72*f* does not interfere with normal usage of the equipment being protected against unauthorized removal, is non-invasive of the equipment and the housing therefor while providing excellent protection against unauthorized removal.

Figure 4:
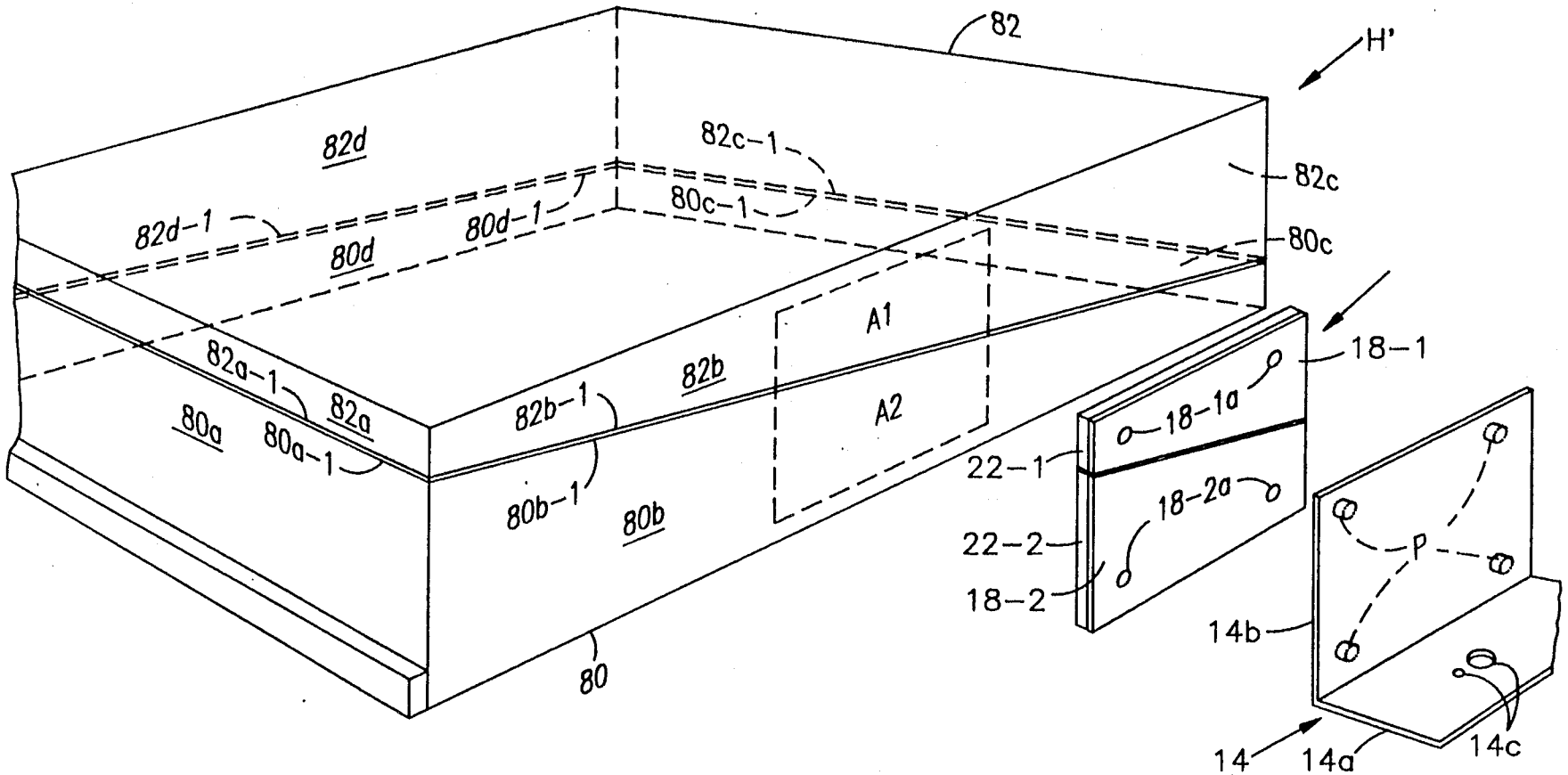
FIG. 4 is an exploded perspective view showing still another alternative embodiment of the present invention.

FIG. 4 shows a modified housing H' for equipment of the type capable of being protected by the security system of the present invention. Noting FIG. 4 there is shown therein a housing of a design typically referred to as being of the clamshell-type in which the housing is comprised of a lower housing portion or base 80 and an upper housing portion or lid 82. The top edge 80*a-1* of the front surface 80*a* is substantially horizontally aligned as is the top edge 80*c-1* of the rear surface 80*c*. However, the top edge 80*a-1* is closer to the top surface of lid portion 82 than edge 80*c-1*. Side surfaces 80*b* and 80*d* have diagonally aligned edges 80*b-1* and 80*d-1*, respectively.

Lid portion 82 of the housing H' has cooperating edges 82*a-1*–82*d-1* which abut against the edges 80*a-1* through 80*d-1*, respectively. The housing halves may be secured by any suitable fasteners (not shown for purposes of simplicity).

For purposes of securing the housing H' and the contents thereof, as well as enabling the housing portions to be disassembled from one another for purposes of maintenance and repair, the present invention is provided with a pair of split side plates, only one of which is shown in FIG. 4 for purposes of simplicity. Side plate assembly 18' is comprised of plate halves 18-1 and 18-2 engaging one another along a diagonally aligned edge substantially aligned with the side edges 80*b-1* and 82*b-1*. Each of the side plate portions are provided with openings 18-1*a* and 8-2*a* for receiving the pins P provided along arm 14*b* of bracket 14 which is substantially identical to the bracket 14 shown in FIG. 1.

The side plate portions 18-1 and 18-2 are each provided with adhesive means 22-1 and 22-2 which are preferably of the type shown, for example, in FIG. 1. These adhesive means adhere to their associated side plate portions and to areas A1 and A2 along the side surfaces 80-*b* and 82-*b* of housing portions 80 and 82.

Side plates of a similar design are arranged to adhere to the side surfaces 80*d* and 82*d* in a similar fashion, said side plate having been omitted from FIG. 4 for purposes of simplicity. The side plate portions engaging the housing sides 80*d* and 82*d* similar to side plate 18' are adapted to receive the pins P of a bracket 16 as shown, for example, in FIG. 1, the brackets 14 and 16 in the embodiment of FIG. 4 being preferably joined in a manner similar to that shown in FIG. 1 and releasably locked by a suitable locking means such as, for example, the locking means 26 of FIG. 1.

In order to gain access to the interior of the housing, the locking means 26 (see FIG. 1) is removed enabling bracket 14 to be removed. Since plate portions 18-1 and 18-2 are separate from one another, the displacement of lid portion 82 from base portion 80 is freely permitted upon removal of the fastening means conventionally utilized to secure the housing portions 80 and 82 together. The plate portions 18-1 and 18-2 remain fixed to the side surfaces of the housing halves and, upon completion of the maintenance or inspection function, return to their aligned position shown in FIG. 4 to facilitate engagement of the side plate openings with the pins P provided along the engaging surface of bracket 14. The present invention is thus capable of readily and easily accommodating housings of the "clamshell" type. The specific shape of the side plates and the alignment of the adjacent edges may obviously be modified to accommodate clamshell housings of different configurations. For example, the edges 80*b-1* and 82*b-1* may be horizontal as opposed to diagonal, the side plates 18-1 and 18-2 being similarly provided with mating edges which are horizontally aligned. Obviously, any other alignment may also be accommodated.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A security system for preventing unauthorized removal of equipment enclosed in a housing having at least first and second opposed exterior surfaces, said system comprising:

a pair of side plates each having substantially flat opposing surfaces;

a pair of adhesive means each having a first adhesive surface secured to one flat surface of an associated one of said plates and a second adhesive surface secured to an associated one of said first and second housing exterior surfaces;

clamping means cooperating with said side plates and movable between a first position for clamping said side plates and said housing therebetween and a second position wherein said clamping means is displaced from said housing and said side plates;

said clamping means including first and second members each respectively engaging one of said side plates;

said first and second members each having an engaging means and said side plates each having a cooperating engaging means whereby said engaging means of each of said first and second members interengage the cooperating engaging means of an associated side plate to prevent said side plates from sliding in a direction parallel to the surface thereof relative to said member when said side plates and members engage one another, said engaging means and cooperating engaging means being configured to allow separation of each said member from engagement with its side plate as said members are moved in a direction perpendicular to the plane occupied by its respective side plate, whereby the shear strength of the adhesive means prevents the removal of the side plates and the housing from said clamping means against any pulling force exerted on the housing in a direction parallel to the flat surfaces of said side plates, when said clamping means is in the clamping position.

2. The security system of claim 1 wherein said adhesive means is taken from a group consisting of single part adhesives which consist of liquids of various viscosity, as well as amorphous materials, films and layered films which includes various types of double-sided tapes and multipart adhesives consisting of two-part epoxies and two-part acrylics and cyanoacrylates.

3. The security system of claim 1 wherein said adhesive means is coated on each major surface with an industrial strength adhesive material.

4. The security system of claim 1 further comprising means for coupling said clamping means to an anchoring structure.

5. The security system of claim 1 wherein said clamping means first and second members further include first and second end brackets each having a first bracket portion engaging an associated side plate and a second bracket portion; and bracket coupling means coupling said second bracket portions of said first and second brackets.

6. The security system of claim 5 wherein said engaging means are arranged on said first bracket portions and comprise projecting pins extending into said cooperating engaging means which comprise cooperating openings provided in said side plates.

7. The security system of claim 5 wherein said engaging means are arranged on said first bracket portions and comprise openings each for receiving one of said cooperating engaging means comprising pins projecting from the surface of said side plate.

8. The security system of claim 5 wherein said bracket coupling means comprises fastening means for securing said brackets in the clamping position.

9. The security system of claim 5 further comprising a base plate and first fastening means for securing said brackets to said base plate and second fastening means for securing said base plate to a supporting surface.

10. The security system of claim 9 wherein said first and second fastening means are arranged between said housing and said supporting surface to prevent access thereto.

11. The security system of claim 9 wherein the second bracket portion of one of said first and second brackets is provided with elongated slots for receiving said first fastening means for adjusting the separation distance between the first bracket portions of said first and second brackets to accommodate housings of varying size.

12. The security system of claim 9 further comprising locking means for releasably coupling one of said brackets to said base plate.

13. The security system of claim 12 wherein said locking means comprises threaded fasteners threadedly engaging at least said base plate and having a tamperproof head.

14. The security system of claim 9 wherein said base plate comprises a pair of spaced base plates each joined to said supporting surface, said base plates being movable relative to one another to accommodate housings of varying size.

* * * * *

UNITED STATES PATENT AND TRADEMARK OFFICE

CERTIFICATE OF CORRECTION

PATENT NO. : 5,076,079

DATED : December 31, 1991

INVENTOR(S) : Monoson et al.

It is certified that error appears in the above-identified patent and that said Letters Patent is hereby corrected as shown below:

In the Abstract, second paragraph, first line, change "matrials" to --materials--

Column 3, line 46, change "docking" to --locking--

Signed and Sealed this

Thirtieth Day of March, 1993

*Attest:*

STEPHEN G. KUNIN

*Attesting Officer*

*Acting Commissioner of Patents and Trademarks*